United States Patent [19]

Maguire

[11] Patent Number: 4,706,552

[45] Date of Patent: Nov. 17, 1987

[54] FURNACE REGISTER HUMIDIFIER

[76] Inventor: James Maguire, 17242-59A Avenue, Surrey, British Columbia, V3S 5S5, Canada

[21] Appl. No.: 725,586

[22] Filed: Apr. 22, 1985

Related U.S. Application Data

[63] Continuation-in-part of Ser. No. 696,414, Jan. 1, 1985, abandoned.

[51] Int. Cl.[4] ..... F24F 7/00

[52] U.S. Cl. ..... 98/30; 98/105

[58] Field of Search ..... 239/44, 43; 98/30, 105; 126/113; 261/107

[56] References Cited

U.S. PATENT DOCUMENTS

| | | | |
|---|---|---|---|
| 966,842 | 8/1910 | Lewis | 98/105 |
| 1,638,605 | 8/1927 | Thorson et al. | 98/105 UX |
| 1,898,785 | 2/1933 | Murdoch et al. | 239/43 |
| 2,173,073 | 9/1939 | Pierson | 261/107 X |
| 4,338,859 | 7/1982 | Claytor | 98/105 |

*Primary Examiner*—William E. Wayner

*Attorney, Agent, or Firm*—Barrigar & Oyen

[57] ABSTRACT

A furnace register humidifier having a rectilinear body formed by a pair of opposed side walls and a pair of end walls. A peripheral lip extends around an open end of the body for supporting the latter from perimeter edges of a floor furnace duct opening. A water trough is formed in an interior of the body extending along a length thereof such that an air flow channel is formed between the trough and a first one of the pair of side walls. The trough is adapted to receive a portion of a water wick extending across the air flow channel. A support is provided for the extended portion of the wick.

4 Claims, 5 Drawing Figures

FURNACE REGISTER HUMIDIFIER

The present application is a continuation-in-part of my prior United States patent application filed Jan. 1, 1985 and assigned Ser. No. 06/696,414, now abandoned.

BACKGROUND OF THE INVENTION

The present invention relates to a furnace register humidifier of a type adapted to be inserted into a floor opening.

The majority of residential buildings having forced air heating employ floor registers supported by the floor area around the opening for the registers. Humidifiers for such a system either have to be installed in the furnace duct, complete with a water line and an electronic control system to control both the rate of water evaporation and the amount of water in the system or, alternatively, a separate self-contained humidifier operating from a single location must be used. The latter units are generally noisy, take up space and include a relatively unreliable assembly of moving parts.

U.S. Pat. No. 2,161,001, issued to Bedol on June 6, 1939 discloses an alternative to a separate motor driven humidifier. The Bedol device includes a shield adapted to be fitted over a floor register and shaped to deflect the upwardly rising air through an approximate 90° angle past a liquid receptacle within the shield. Although vapour from the liquid enters the air stream, since only the surface of the liquid contacts the air, the rate at which vapour enters the air stream is relatively low. Moreover, the obtrusiveness of the shield into a room presents a serious disadvantage.

An alternative humidifier for use in combination with the register of a hot air furnace is disclosed by U.S. Pat. No. 3,227,064, issued on Jan. 6, 1966 to Spangle.

Spangle discloses a grille unit for use with a register in a vertical wall, having a liquid trough along its base and a plurality of spaced apart water-absorbing strips, the bottoms of which are immersed in the water of the trough. Air flowing by the water saturated strips becomes humidified before exiting therefrom into a room. However, only the air which actually contacts one of the strips in passing through the grille is effective in vapourizing the water. Moreover, the construction of the Spangle grille does not extend itself readily to a grille unit for use with a floor register.

U.S. Pat. No. 3,673,770, issued July 4, 1972 to Novak discloses a humidifier attachment for a vertical wall register consisting of a water filled box with hooks to hang the box immediately below the register and artificial plants having a wick-like rear surface immersed in the box to put moisture into the air.

U.S. Pat. No. 4,226,174, issued Oct. 7, 1980 to Vesper, discloses another type of vertical wall register humidifier similar to the Spangle humidifier.

U.S. Pat. No. 4,307,656, issued Dec. 29, 1981 to Vesper, discloses a humidifier for use in combination with a floor register which utilizes a deflector for deflecting upwardly rising air through a plurality of vertically spaced apart evaporation plates. The Vesper device aforesaid is adapted to be located atop the floor register and therefore represents an unsightly, obtrusive mechanism.

SUMMARY OF THE INVENTION

According to the invention there is provided a furnace register humidifier which includes a substantially rectilinear body having a pair of opposed side walls, a pair of end walls and a peripheral lip extending around an open end of the body for supporting it from a perimeter of a floor furnace duct opening. A water trough is formed in an interior of the body which extends along a length thereof such that an air flow channel is formed between the trough and the first one of the side walls. The trough is adapted to receive a portion of a water wick the remainder of which extends across the air flow channel. Means are provided for supporting the extended portion of the water wick.

The supporting means may be a second water trough extending along the length of an interior of the body proximate the first side wall.

Advantageously the humidifier may include an elongated rib extending over the air flow channel along a length thereof and positioned so as to support the water wick intermediate the troughs above open ends thereof.

Alternatively a single trough may be positioned between the side wall such that a pair of air flow channels are defined between the trough and each of the side walls. The trough may be adapted to receive a water wick the sides of which extend over an open end of the trough across the respective air flow channels. Means for affixing the wick ends proximate the side walls may be provided as may means for holding a central portion of the wick proximate a bottom of the trough.

Advantageously, the water wick may have a porosity sufficiently high to permit air flow therethrough, but at the same time low enough to permit sufficient water flow along the wick without dripping. The size of the holes in the water wick may be sufficiently small and of a sufficiently high density to filter the air passing therethrough.

Preferably, the ends of the wick may be attached proximate a bottom end of respective ones of the side walls such that upon air passing therethrough, the wick has a sufficient length between the trough open end and the attached wick end to bellow out. The side walls may extend beyond the end walls so as to provide associated side wall attachment ends. A pair of elastomeric fasteners may be provide to attach each of the wick ends when folded around the respective side wall attachment ends to the latter. The holding means may be a rod extending substantially the length of the trough for placement atop the wick to hold the latter down. The rod may removably engage the end walls.

A grille may be provided having adjustable openings which are removably engageable with an open end of the rectilinear body. Preferably the wick is made of a fabric material.

Unlike prior known devices, the present invention provides a device which is completely unobtrusive, being located below the floor level and which is extremely simple to maintain in operation. All that is required of the user is simply to refill the trough from time to time with water. The present invention has no moving parts and, accordingly, is significantly more reliable than prior known devices having motors and the like.

BRIEF DESCRIPTION OF THE DRAWINGS

In drawings of a preferred embodiment of the invention.

DETAILED DESCRIPTION WITH REFERENCE TO THE DRAWINGS

Figure 1:
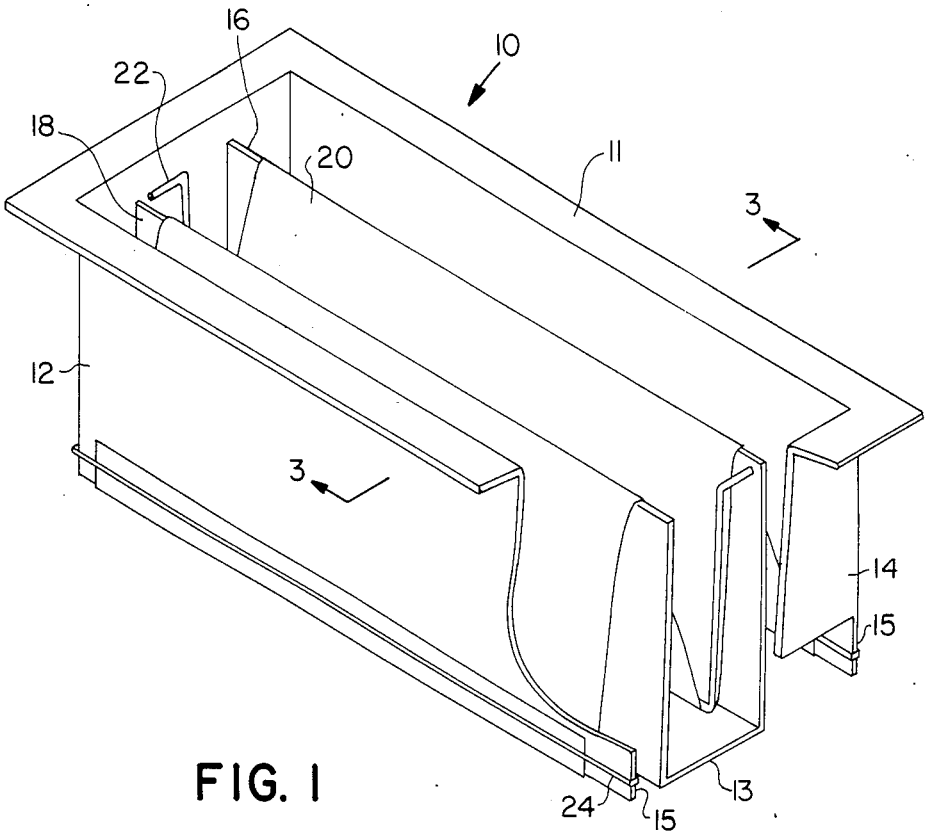
FIG. 1 is a perspective view of that portion of the furnace register humidifier that fits into a floor receptacle with a portion cut away.
Figure 3:
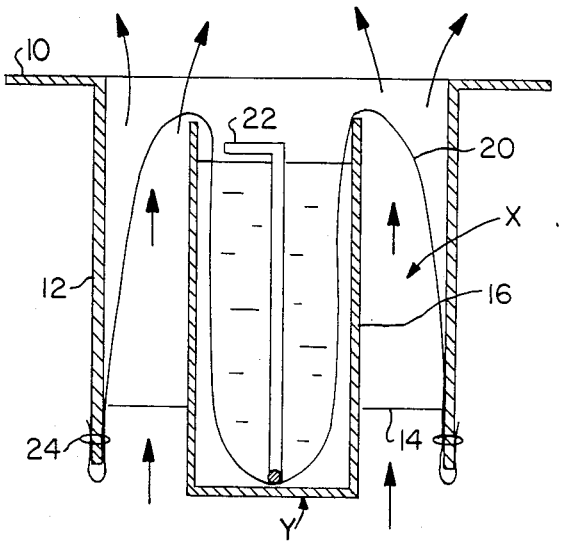
FIG. 3 is an end elevation view in section along line 3—3 of FIG. 1.

A preferred embodiment of the furnace register humidifier as shown in FIGS. 1 and 3 consists of a rectilinear body 10 having a pair of side walls 12, a pair of end walls 14, and a peripheral lip 11 extending around an open end of the side walls 12 and end walls 14. The dimensions of the body 10 are such that the side walls 12 and end walls 14 pass through a heating duct outlet opening (not shown) in a floor of a building having a forced air furnace with the perimeter of the floor duct opening engaging lip 11 which thereby supports rectilinear body 10.

A trough 13 extends along the length of the interior of the body 10 having trough side walls 16 and 18 joined to the interior of end walls 14. Trough 13 is closed at both ends so that it can retain a fluid such as water. End walls 14 extend down from lip 11 a slightly shorter distance than side walls 12, thereby forming side wall attachment ends 15. The space between trough side walls 16 and 18 and body side walls 12 define a pair of air flow channels for permitting the passage of air therethrough.

A water wick 20 consisting of an elongated flexible water conducting material is inserted into the trough 13 such that the central portion thereof is held in place at the bottom of the trough 13 by means of a clip 22. An alternative method of so holding the cloth is to use a weighted rod (not shown). Water wick 20 is then draped over the upper edges of trough side walls 16 and 18 and then looped around the bottom of side walls 12 and retained in place by means of an elastic member 24 engaging the cloth against respective side wall attachment ends 15. The length of the water wick 20 is such that sufficient slack exists to permit the water wick 20 to bellow up in response to upwardly rising air as shown in FIG. 3.

Figure 2:
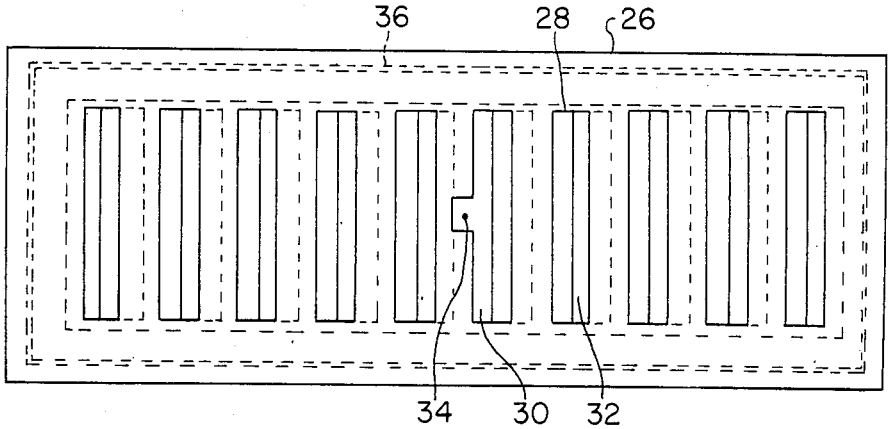
FIG. 2 is a plan view of a grille which is adapted to fit onto the portion of FIG. 1.

As shown in FIG. 2, grille 26 has a rectangular sleeve proximate an outer edge thereof dimensioned so as to snugly slidably engage an open end of body 10 and thereby hold grille 26 in place. Grille 26 also has a plurality of spaced apart rectilinear apertures 28 regularly spaced along the length thereof. Slidably mounted to the underside of grille 26 is a second plate 30 also having a plurality of regularly spaced apart rectilinear apertures of substantially the same size and spacing as apertures 28. A knob 34 affixed to the slidable plate 30 allows manual sliding adjustment of the grille 26 by adjusting the amount of overlap of apertures 28 with apertures 32.

Water wick 20 is designed with a plurality of uniformly spaced small apertures over the surface thereof, thereby providing the latter with sufficient porosity to permit air to pass therethrough. At the same time the apertures are not so large and numerous so as to prevent conduction of sufficient water so as to adequately humidify a room. Adjustment of the size and spacing of the wick holes is also selected to prevent excessive water conduction which would result in dripping from the bottom of the wick where it is attached to the side wall attachment ends 15. The size and spacing of the wick apertures obviously will depend on the frequency with which the forced air furnace turns on and the amount of air flowing out each floor opening. By choosing a high density of small holes the water wick also functions to filter the air passing therethrough. The trough may require filling anywhere from approximately three to eight hours depending upon the room humidity required. Filling may be accomplished by simply opening grille 26 and filling the trough 13 with a water can, preferably having a narrow spout at the end thereof.

It will be appreciated that instead of providing a single rectilinear sheet of wick 20, one may instead provide a plurality of spaced apart strips or a single wick wherein a plurality of sections thereof are cut out so as to permit the passage therethrough of air. However, the filtering effect of the wick in such a case is reduced. In this case it would not be necessary to provide a water wick having a relatively high porosity to permit air flow therethrough.

It is also clear to those skilled in the art that other means of attaching the ends of water wick 20 so that there is a reasonable expanse of wick material over the air flow channels can be achieved. For example, members can be attached to the bottom of trough 13 which extend out either side across the air flow channels to which the wick 20 can be attached.

It has been found that by providing some slack in the water wick 20 so as to permit it to bellow upwardly upon being impacted by upwardly rising hot air, a much more efficient evaporation process occurs. This may be in part due to the greater amount of cloth apertures through which the hot air may pass as well as the greater conductivity properties of the water wick 20 when in a relaxed rather than a tensioned condition.

It will also be obvious that the device will be operable even if the ends of water wick 20 are attached proximate the top end of side walls 12 rather than at the bottom end. However, because of the smaller amount of cloth then in the air stream, it is expected that a lower rate of evaporation would result.

Figure 4:
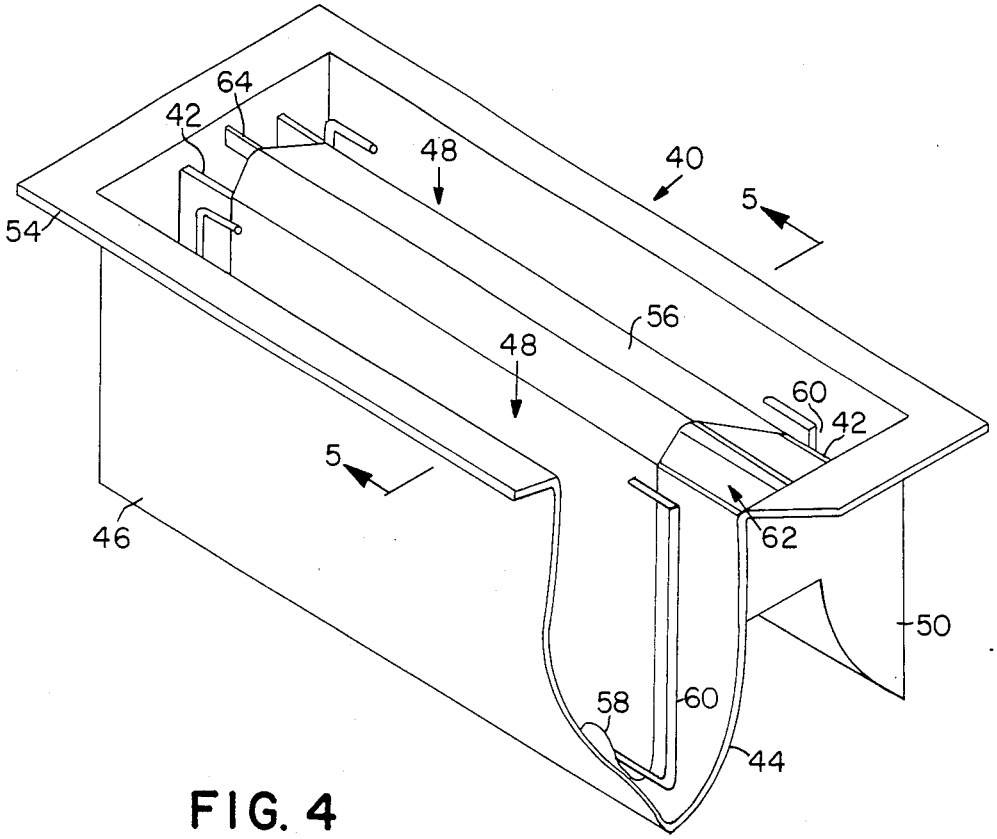
FIG. 4 is a perspective view of an alternative embodiment of the invention; and, FIG. 5 is an end elevation view in section 5 along line 5—5 of FIG. 4.
Figure 5:
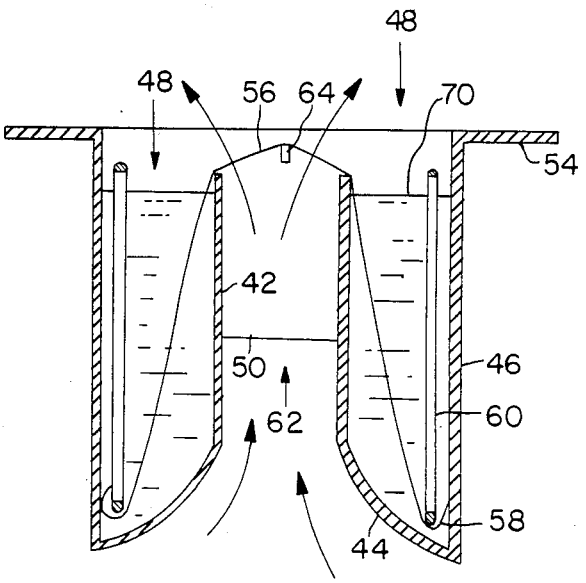

An alternative embodiment of the furnace register humidifier is shown in FIGS. 4 and 5 as consisting of side walls 46 and end walls 50 in a rectilinear shape and having a peripheral lip 54 for supporting the structure from a standard furnace duct opening. A pair of troughs 48 are formed by interior walls 42 the bottoms 44 of which are curved to join the exterior side walls 46. Side walls 42 extend along the length of the humidifier 40 and are integral with end walls 50. An air flow channel 62 is formed between the side walls 42. An elongated rib 64 extends across the air flow channel and is positioned so as to support a water wick 56 slightly above upper ends of interior walls 42. A pair of U-shaped rods 60 are dimensioned to fit within troughs 48 and are used to hold down ends of water wick 56 and thereby prevent them from floating to the surface. Each trough 48 is sealed so as to be able to contain water 70.

In operation, water travels along the water wick 56 from each trough 48 thereby keeping the latter in a moist condition. Furnace air flowing up through air flow channel 62 passes through water wick 56 and causes evaporation of the water therein. Because the portion of the water wick 56 which extends over the air flow channel 62 does not have any portion which droops below the upper ends of side walls 42 there is no tendency for any dripping to take place. Consequently, it is unimportant as to the inherent porosity of the water wick or any of its other properties in order for it to function adequately. Any excess water conducted out of one water trough must simply flow into an opposite water trough so that the two water troughs compensate the water flow from each other. Over a period of time, the filtering effect of the wick reduces due to a build-up of fine particles captured from the air and this portion of the wick becomes hardened and ceases to conduct water.

The U-shaped rods 60 may be dispensed with by employing a rigid water wick 56. Such a water wick may be formed, for example, by utilizing a wire mesh to support a flexible wick or, alternatively, by forming a plurality of spaced apart rigid ribs in a flexible material. In either of the latter cases the elongated ribs 64 may be dispensed with because of the self-supporting characteristics of a rigid water wick.

Other variations, modifications, and departures lying within the spirit of the invention and scope as defined by the appended claims will be obvious to those skilled in the art.

I claim:

1. A forced air furnace register humidifier, comprising:

(a) a substantially rectilinear body adapted for placement in a furnace duct outlet, having a pair of opposed side walls, a pair of end walls and a generally open top;

(b) means for supporting said body from a perimeter of a floor furnace duct outlet;

(c) two parallel troughs for holding water formed in the interior of said body and having bottom and side walls;

(d) an air flow channel formed centrally in said rectilinear body between said parallel troughs to allow passage of the air forced from said furnace; and (e) an air-permeable, porous, water-absorbent web, a raised central portion of said web extending across said air flow channel in the path of said forced air, and side portions of said web extending downwardly into said water-containing troughs.

2. A furnace register humidifier as defined in claim 1 wherein said means for supporting comprises a horizontal lip extending from the upper edge of said rectilinear body.

3. A furnace register humidifier as defined in claim 1 further comprising frame means for securing said downwardly-extending portions of said web in said water-containing troughs and for suspending said raised central portion of said web across said air flow channel.

4. A forced air furnace register humidifier comprising:

(a) a substantially rectilinear body adapted for placement in a furnace duct outlet, having a pair of opposed side walls, a pair of end walls and a generally open top;

(b) means for supporting said body from a perimeter of a floor furnace duct outlet;

(c) a container for holding water having bottom and side walls formed in the interior of said body;

(d) a pair of air flow channels formed in the interior of said body between said water container and respective ones of said side walls of said rectilinear body to allow passage of the air forced from said furnace;

(e) an air-permeable, porous, water-absorbent web extending across said air flow channels in the path of said forced air, wherein a portion of said web is located in said water container;

(f) means for holding a central portion of said wick proximate the bottom of said water container and means for affixing the ends of said web proximate said side walls wherein said ends of said web are attached proximate a bottom end of respective ones of said side walls; and (g) a pair of elastomeric fasteners wherein each of said web ends are folded around respective bottom portions of said side walls and are retained by respective ones of said elastomeric fasteners looped around respective bottom portions of said side walls over the associated web ends.

* * * * *